US010168638B2

(12) United States Patent
Ushikubo

(10) Patent No.: US 10,168,638 B2
(45) Date of Patent: Jan. 1, 2019

(54) DEVELOPER CONTAINER HOLDER, DEVELOPER CONTAINER, AND IMAGE FORMING APPARATUS

(71) Applicant: Oki Data Corporation, Tokyo (JP)

(72) Inventor: Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/787,053

(22) Filed: Oct. 18, 2017

(65) Prior Publication Data

US 2018/0113416 A1 Apr. 26, 2018

(30) Foreign Application Priority Data

Oct. 24, 2016 (JP) ..... 2016-207740

(51) Int. Cl.
*G03G 15/08* (2006.01)
*G03G 21/18* (2006.01)

(52) U.S. Cl.
CPC ..... *G03G 15/0832* (2013.01); *G03G 15/0886* (2013.01); *G03G 21/1842* (2013.01);
(Continued)

(58) Field of Classification Search
CPC ..... G03G 15/087; G03G 15/0832; G03G 15/0836; G03G 15/0837; G03G 15/0839; G03G 15/0865; G03G 15/0867; G03G 15/0872; G03G 15/0875; G03G 15/0877; G03G 15/0879; G03G 2215/066; G03G 2215/067; G03G 2215/068; G03G 2215/0663; G03G 2215/0665; G03G 2215/0668; G03G 2215/0673; G03G 2215/0675; G03G 2215/0678; G03G 2215/0692; G03G 2221/1654
See application file for complete search history.

(56) References Cited

U.S. PATENT DOCUMENTS

2006/0067733 A1* 3/2006 Kawasumi ..... G03G 21/1853 399/111
2008/0080902 A1* 4/2008 Saito ..... G03G 21/1633 399/262

(Continued)

FOREIGN PATENT DOCUMENTS

JP 2014102385 A 6/2014

*Primary Examiner* — Thomas Giampaolo, II
(74) *Attorney, Agent, or Firm* — Panitch Schwarze Belisario & Nadel LLP

(57) ABSTRACT

A developer container holder for holding a developer container including a developer supply port and a shutter for opening and closing the developer supply port guides the developer container in a first direction when the developer container is attached to the developer container holder and in a second direction when the developer container is removed from the developer container holder, and includes: a holder that holds the developer container; a support that supports the holder slidably within a region in a direction in which the developer container is attached to and removed from the developer container holder; and an elastic member placed between the holder and the support to urge the holder in the first direction when the holder is on a first side of a position in the region and in the second direction when the holder is on a second side of the position in the region.

15 Claims, 14 Drawing Sheets

(52) U.S. Cl.
CPC ..... *G03G 2215/0692* (2013.01); *G03G 2221/1807* (2013.01); *G03G 2221/1869* (2013.01)

(56) References Cited

U.S. PATENT DOCUMENTS

2010/0166460 A1* 7/2010 Maeshima ..... G03G 15/0875 399/119
2017/0329277 A1* 11/2017 Ushikubo ..... G03G 21/1647

* cited by examiner

DEVELOPER CONTAINER HOLDER, DEVELOPER CONTAINER, AND IMAGE FORMING APPARATUS

BACKGROUND OF THE INVENTION

1. Field of the Invention

The present invention relates to a developer container holder, a developer container, and an image forming apparatus.

2. Description of the Related Art

Japanese Patent Application Publication No. 2014-102385 discloses an image forming apparatus in which a toner cartridge is slid and attached to a toner cartridge holding unit (see, e.g., page 10 and FIG. 3).

However, in the above image forming apparatus, operational procedures, including a locking operation, for attaching and removing the toner cartridge are complicated. This may lead to an erroneous operation, such as an attachment failure.

SUMMARY OF THE INVENTION

According to an aspect of the present invention, there is provided a developer container holder for removably holding a developer container including a developer supply port and a shutter for opening and closing the developer supply port, the developer container holder guiding the developer container in a first direction when the developer container is attached to the developer container holder and in a second direction when the developer container is removed from the developer container holder, the developer container holder including: a holder that holds the developer container; a support that supports the holder slidably within a predetermined slide region in an attachment direction in which the developer container is attached to and removed from the developer container holder; and an elastic member placed between the holder and the support, the elastic member urging the holder in the first direction when the holder is located on a first side of a predetermined position in the slide region and in the second direction when the holder is located on a second side of the predetermined position in the slide region.

According to another aspect of the present invention, there is provided a developer container configured to be removably held by the above developer container holder, the developer container including: a main body including a developer storing portion that stores developer; a developer supply port that discharges the developer stored in the developer storing portion; a shutter slidably held by the main body to open and close the developer supply port; an urging member that urges the shutter in the first direction to close the shutter; and an engagement portion formed on the shutter, the engagement portion engaging with the shutter movement limiter of the developer container holder to prevent movement of the shutter in the first direction, wherein when the developer container is positioned at a predetermined attachment position, the shutter is opened against urging force of the urging member.

DETAILED DESCRIPTION OF THE INVENTION

An embodiment of the present invention will now be described with reference to the attached drawings.

Figure 1:
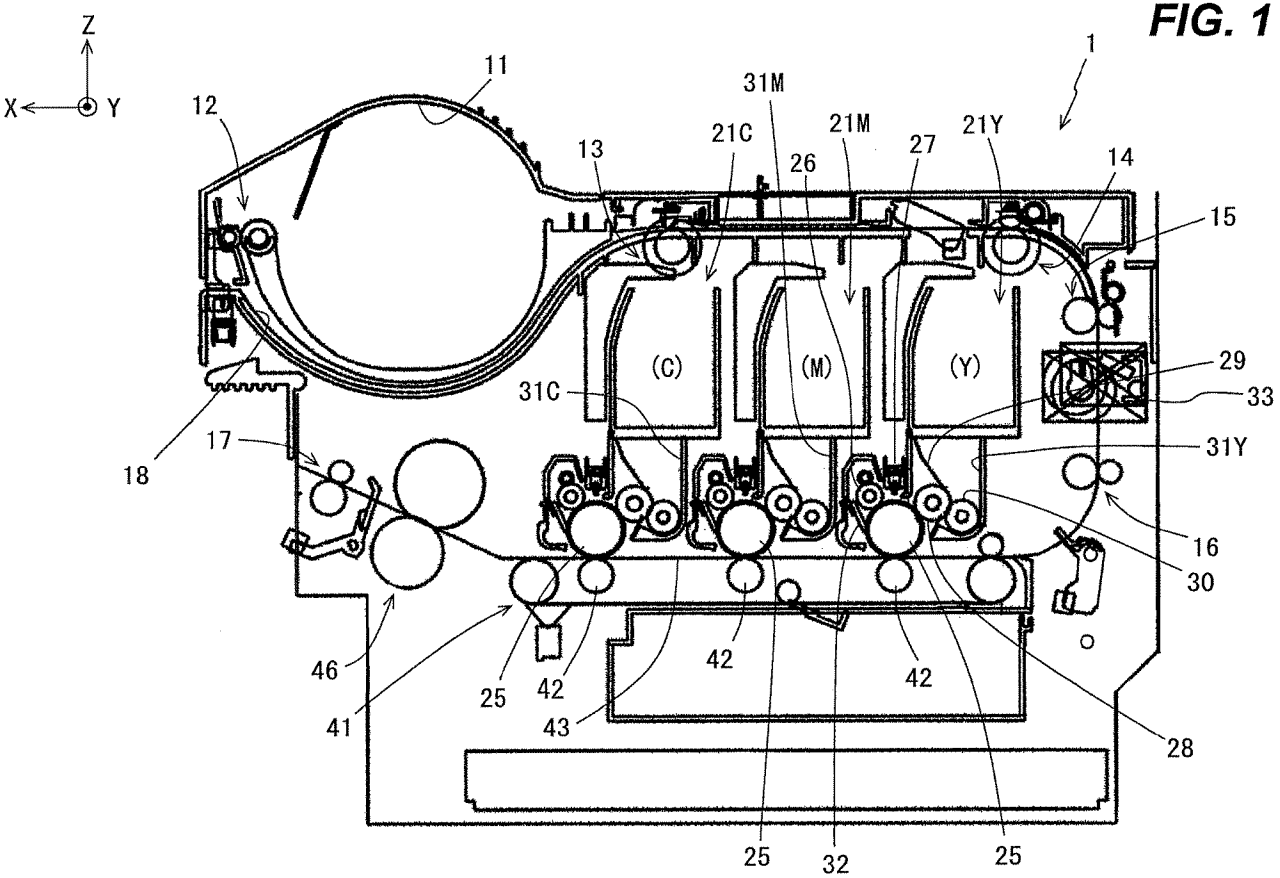
FIG. 1 is a configuration diagram illustrating the main components of an image forming apparatus including a stage according to an embodiment of the present invention.

FIG. 1 is a configuration diagram illustrating the main components of an image forming apparatus 1 including a stage 3 (not illustrated in FIG. 1) as a developer container holder according to the embodiment of the present invention.

As illustrated in FIG. 1, the image forming apparatus 1, which is an electrophotographic color printer, includes a generally C-shaped paper conveying path 18. A paper roll holder 11 in which a paper roll is set is disposed at an upstream end of the paper conveying path 18. The image forming apparatus 1 includes, along the paper conveying path 18, a pair of conveying rollers 12 that feeds paper (or a paper web) from the paper roll set in the paper roll holder 11 into the paper conveying path 18, pairs of conveying rollers 13 to 16 that convey the fed paper, a transfer belt unit 41 including a transfer belt 43 that electrostatically attracts and conveys the paper conveyed by the pairs of conveying rollers 13 to 16, transfer rollers 42 that transfer toner images onto the paper, a fixing unit 46 that fixes the toner images to the paper, and a pair of conveying rollers 17 that is disposed at a downstream end of the paper conveying path 18 and discharges the paper outside the image forming apparatus 1.

Image forming units 21Y, 21M, and 21C are aligned in this order from the upstream side to the downstream side in the conveying direction of the paper so that the paper attracted and conveyed by the transfer belt 43 is sandwiched between the image forming units 21Y, 21M, and 21C and the transfer belt unit 41. The image forming units 21Y, 21M, and 21C respectively store toners of yellow (Y), magenta (M), and cyan (C). When the image forming units 21Y, 21M, and 21C need not be distinguished from each other, they will be referred to as the image forming units 21.

In this embodiment, the image forming units 21Y, 21M, and 21C have the same configuration except that they store toners of different colors, so the internal configuration of the image forming unit 21Y will be representatively described below. With respect to a certain component, such as one of the image forming units 21, of the image forming apparatus 1, the portion of the image forming apparatus 1 excluding the component may be referred to as the main body of the image forming apparatus 1.

The image forming unit 21Y includes a photosensitive drum 25 as an electrostatic latent image carrier, a charging roller 26 that uniformly charges a surface of the photosensitive drum 25, a developing roller 28 as a developer carrier that applies yellow toner as developer to an electrostatic latent image formed on the surface of the photosensitive drum 25 to form a toner image, and a supply roller 30 pressed against the developing roller 28.

The supply roller 30 supplies yellow toner stored in a toner storing portion 31Y to the developing roller 28. A developing blade 29 is pressed against the developing roller 28. The developing blade 29 forms the toner supplied from the supply roller 30 into a thin layer on the developing roller 28. A cleaning blade 32 is pressed against the surface of the photosensitive drum 25 and scrapes off toner remaining on the photosensitive drum 25 after transfer (described later).

Above the photosensitive drum 25, an exposure device 27 is disposed to face the photosensitive drum 25. The exposure device 27 exposes the photosensitive drum 25 according to image data for the corresponding color to form an electrostatic latent image on the surface of the photosensitive drum 25. The above components constitute the image forming unit 21Y.

FIG. 1 shows X, Y, and Z axes. The X axis extends in a direction in which the paper fed from the paper roll passes through the image forming units 21. The Y axis extends in a direction of rotational axes of the respective photosensitive drums 25 of the image forming units 21. The Z axis extends in a direction perpendicular to both the X and Y axes. The positive direction of the X axis (or the direction of arrow X in FIG. 1) will be referred to as the positive X direction, and the negative direction of the X axis (or the direction opposite to arrow X in FIG. 1) will be referred to as the negative X direction. The same applies to the other drawings except FIGS. 15A to 15D. In each of the other drawings, the X, Y, and Z axes indicate the orientation of the part illustrated in the drawing when the part is installed in the image forming apparatus 1. Here, the image forming apparatus 1 is placed so that the Z axis extends in a substantially vertical direction.

The printing operation of the image forming apparatus 1 configured as above will be described with reference to FIG. 1.

Paper drawn from a paper roll (not illustrated) installed in the paper roll holder 11 is fed by the pair of conveying rollers 12 from its leading edge into the paper conveying path 18, further conveyed by the pairs of conveying rollers 13 to 16 along the paper conveying path 18 onto the transfer belt 43, and conveyed by the transfer belt 43 to the image forming units 21Y, 21M, and 21C in this order.

Meanwhile, in each of the image forming units 21, the surface of the photosensitive drum 25 is uniformly charged by the charging roller 26 and exposed by the corresponding exposure device 27. At this time, the exposure device 27 illuminates the surface of the photosensitive drum 25 with light whose amount is adjusted based on image data supplied from a host device (not illustrated), thereby forming an electrostatic latent image on the surface. Toner in the thin layer on the developing roller 28 electrostatically adheres to the portion of the photosensitive drum 25 where the electrostatic latent image is formed, thereby forming a toner image on the photosensitive drum 25.

The toner images formed on the respective photosensitive drums 25 are sequentially transferred onto the paper by the corresponding transfer rollers 42 to which bias voltages are applied, in a superposed manner, so that a color toner image is formed on the paper. Toner (or residual toner) remaining on the photosensitive drums 25 after the transfer is scrapped off by the cleaning blade 32.

The paper with the color toner image transferred thereon is conveyed to the fixing unit 46. The fixing unit 46 heats and presses the color toner image to fix it to the paper, so that a color image is formed. The paper with the color image formed thereon is discharged by the pair of conveying rollers 17 outside the image forming apparatus 1. The paper is cut by a cutter 33 as necessary while being conveyed in the apparatus.

Figure 2:
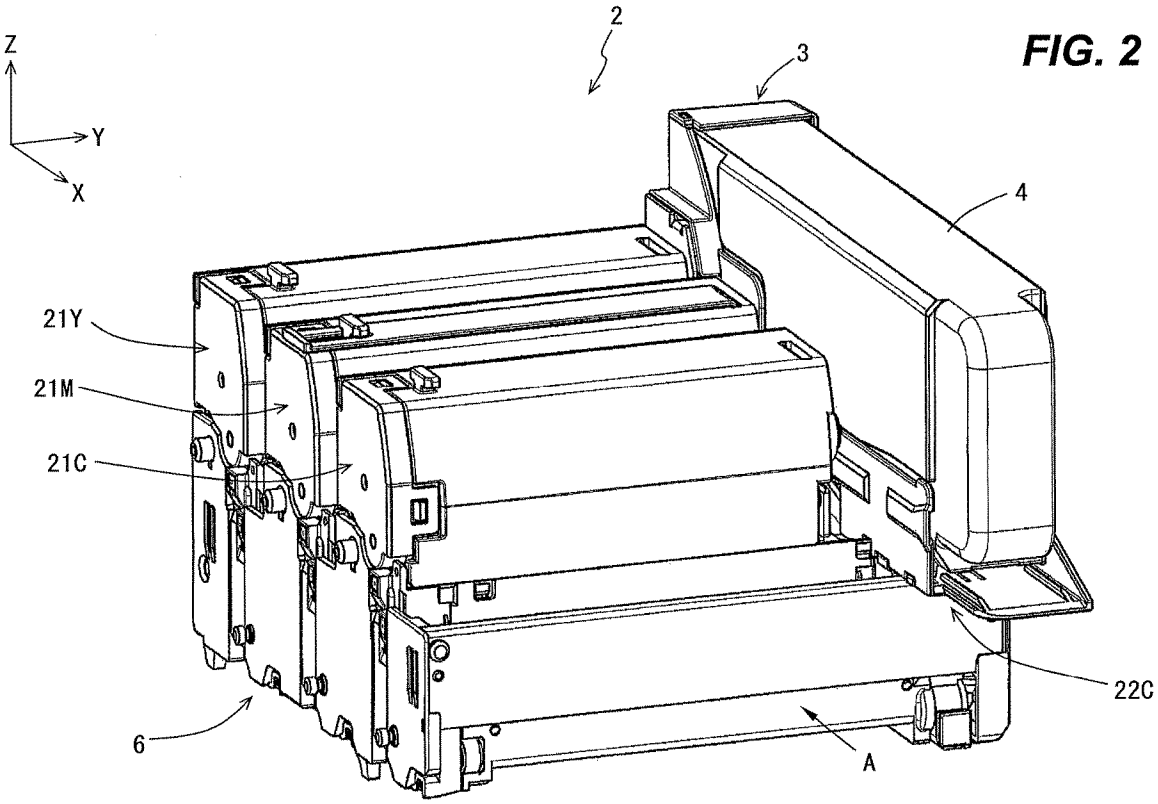
FIG. 2 is an external perspective view of a toner image forming portion of the image forming apparatus according to the embodiment.

FIG. 2 is an external perspective view of a toner image forming portion 2 of the image forming apparatus 1.

As illustrated in FIG. 2, the toner image forming portion 2 includes a sub-chassis 6 and the stage 3 disposed on the sub-chassis 6. The three image forming units 21Y, 21M, and 21C are mounted on the sub-chassis 6 so that the sub-chassis 6 and image forming units 21 are integrated. A toner cartridge 4 is removably attached to the stage 3. FIG. 2 illustrates a state where the toner cartridge 4 has been attached to the stage 3.

The toner image forming portion 2 is disposed in the main body of the image forming apparatus 1 so that the respective photosensitive drums 25 of the three image forming units 21Y, 21M, and 21C face the corresponding transfer rollers 42 as illustrated in FIG. 1 and the toner image forming portion 2 receives rotational driving force for rotary parts of the image forming units 21Y, 21M, and 21C from the main body of the image forming apparatus 1.

Figure 3:
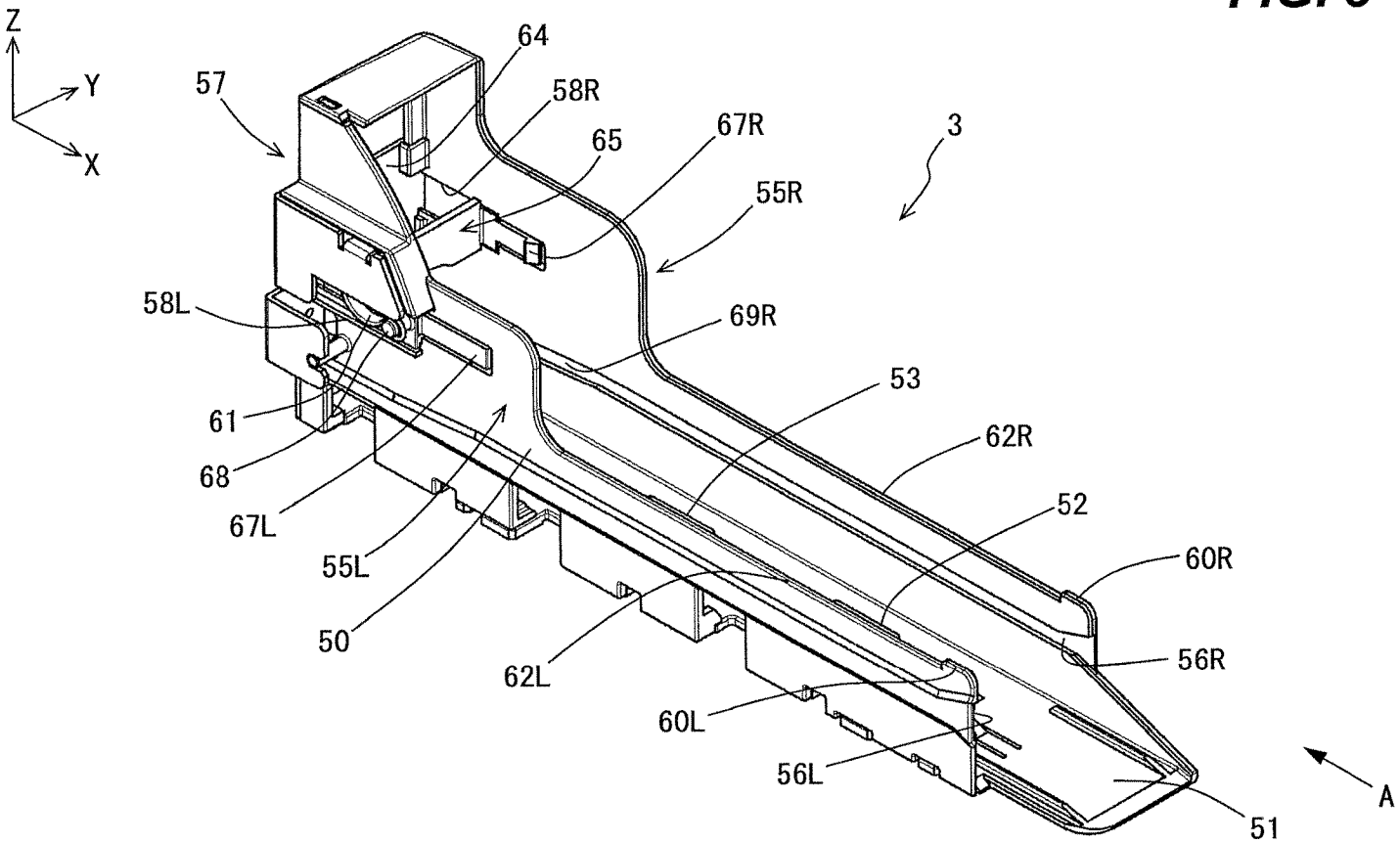
FIG. 3 is an external perspective view of the stage as viewed obliquely from above.
Figure 4:
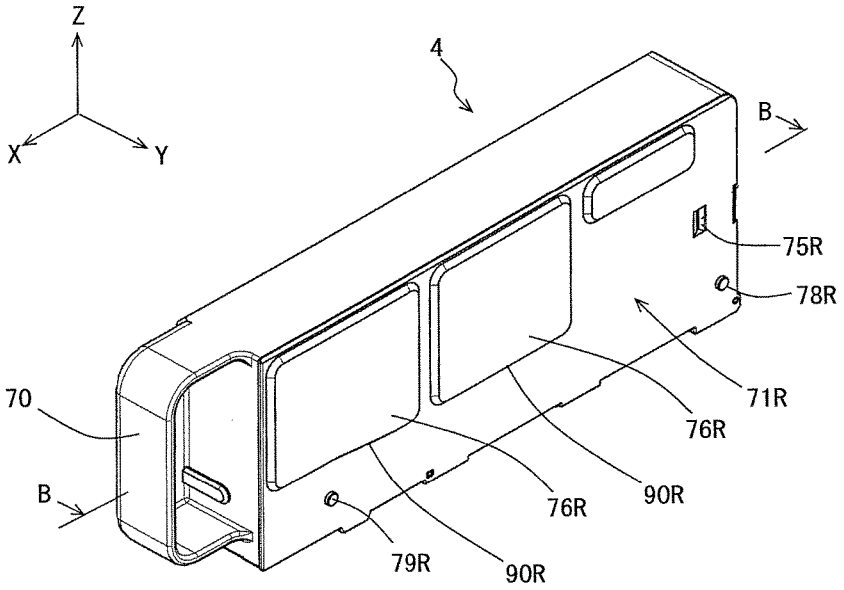
FIG. 4 is an external perspective view of a toner cartridge as viewed obliquely from above.
Figure 5:
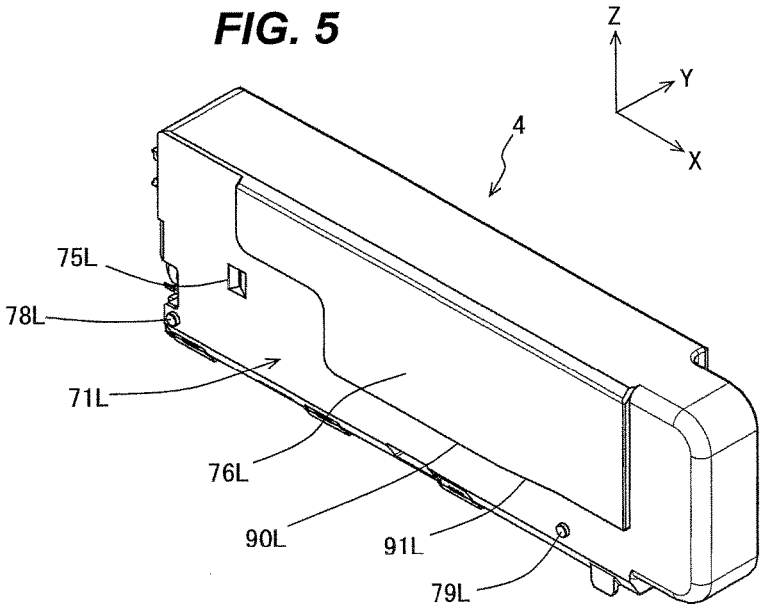
FIG. 5 is another external perspective view of the toner cartridge as viewed obliquely from above.
Figure 6:
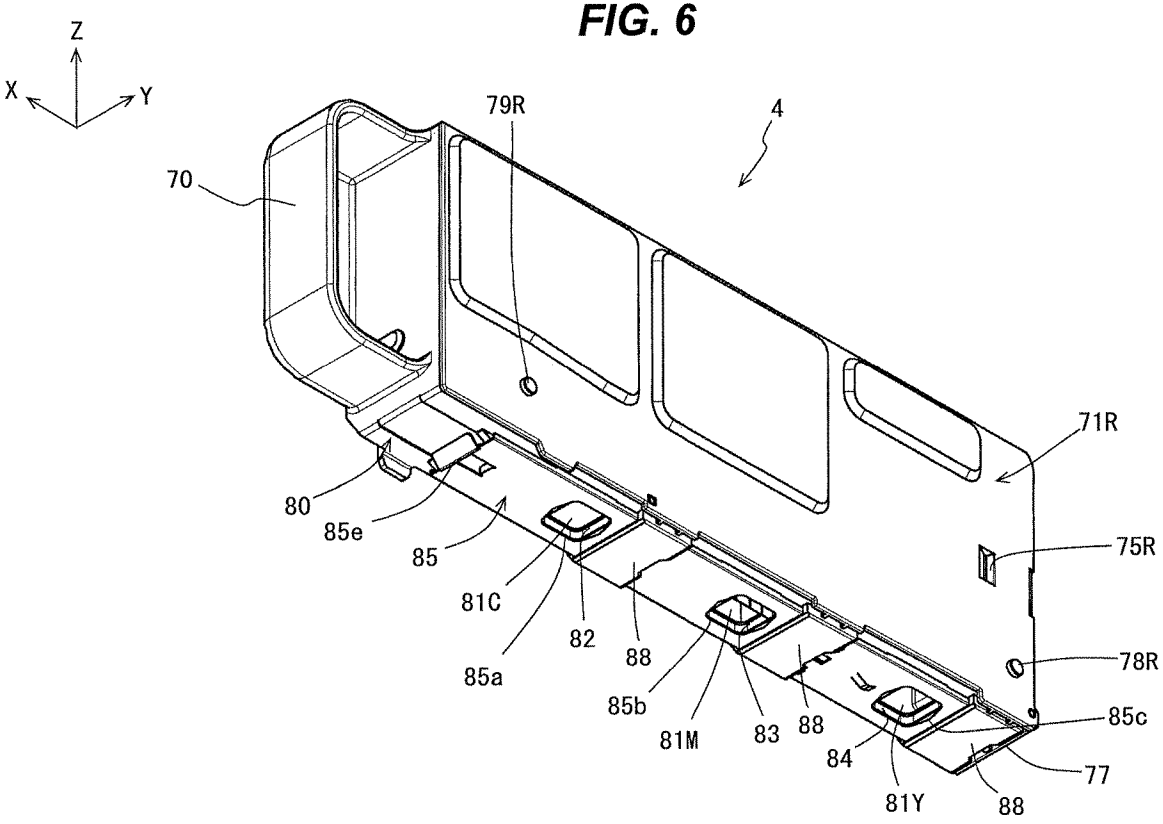
FIG. 6 is still another external perspective view of the toner cartridge as viewed obliquely from below.
Figure 7:
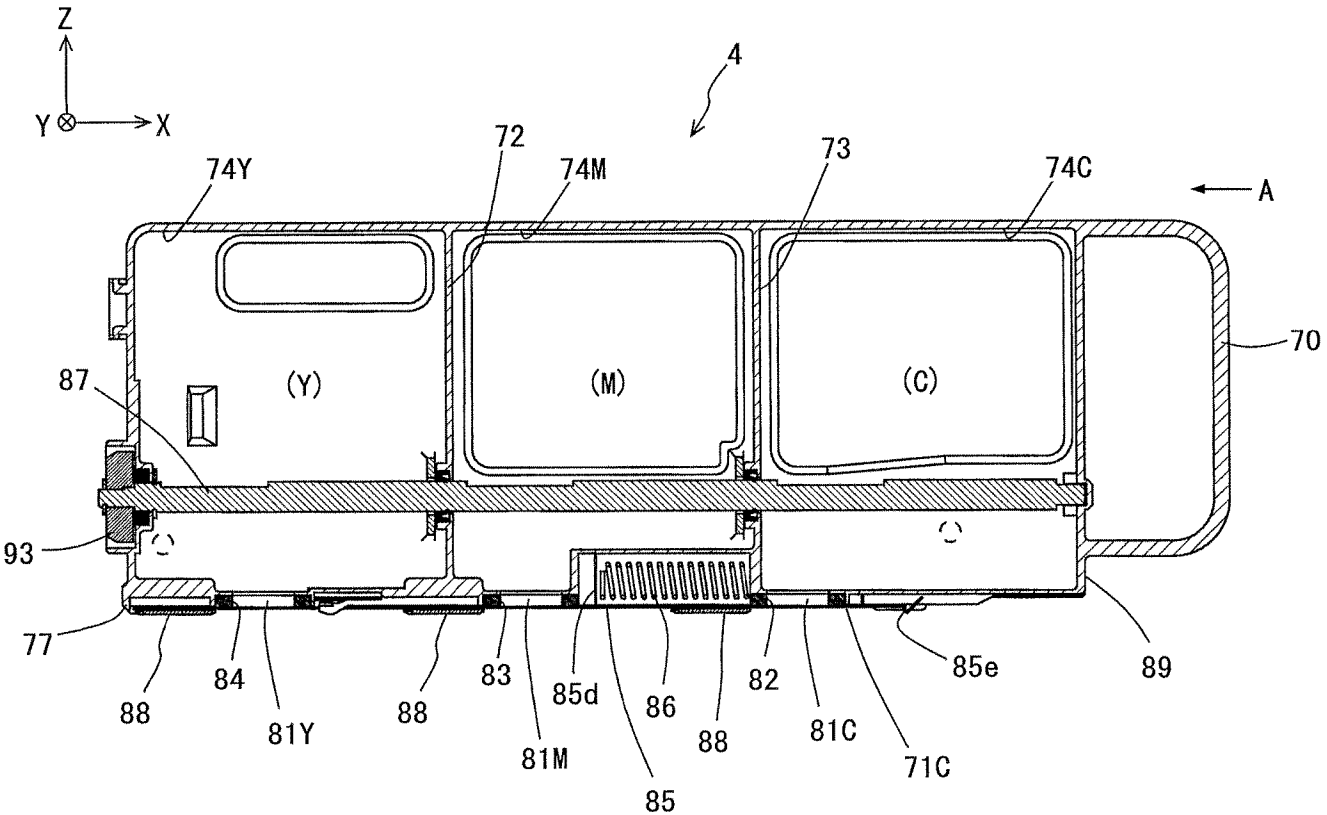
FIG. 7 is a sectional view taken along line B-B in FIG. 4.

FIG. 3 is an external perspective view of the stage 3 as a developer container holder as viewed obliquely from above. FIG. 4 is an external perspective view of the toner cartridge 4 as a developer container as viewed obliquely from above. FIG. 5 is another external perspective view of the toner cartridge 4 as viewed obliquely from above. FIG. 6 is a still another external perspective view of the toner cartridge 4 as viewed obliquely from below. FIG. 7 is a sectional view taken along line B-B in FIG. 4.

FIGS. 2 to 7 each illustrate a component or unit constituting the image forming apparatus 1. As described above, for each of these drawings, the X, Y, and Z axes may be used to describe the orientation of the component or unit illustrated in the drawing when the component or unit is placed in the image forming apparatus 1.

Figure 16:
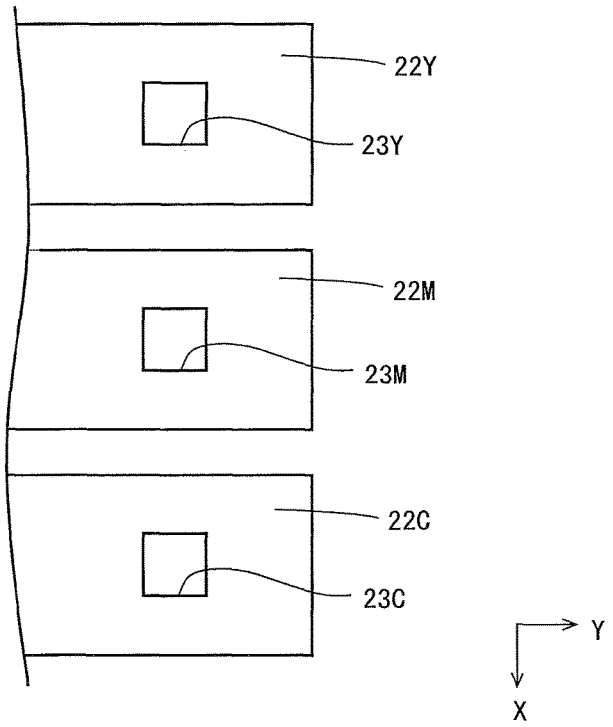
FIG. 16 is a schematic diagram illustrating stage placing portions of the image forming apparatus.

In a state where the three image forming units 21Y, 21M, and 21C are mounted on the sub-chassis 6 and assembled integrally with the stage 3 as illustrated in FIG. 2, the three image forming units 21Y, 21M, and 21C are, for example, aligned in a predetermined direction at predetermined intervals as illustrated in FIG. 1, and the stage 3 is disposed on stage placing portions 22Y, 22M, and 22C (see FIG. 16) of the respective image forming units 21Y, 21M, and 21C to connect the stage placing portions 22Y, 22M, and 22C. Each of the stage placing portions 22Y, 22M, and 22C is formed on one side (or the right side) of the corresponding image forming unit 21.

In this embodiment, directional terms, such as "front", "rear", "left", and "right", may refer to directions when the toner image forming portion 2 is viewed from the side from which the paper is discharged (or viewed in the direction of arrow A).

The stage 3 is disposed so that its longitudinal direction, which extends in an insertion/removal direction (described later) of the toner cartridge 4, coincides with the direction in which the three image forming units 21Y, 21M, and 21C are arranged. The stage 3 includes a bottom portion 51 with openings 52, 53, and 54 (see FIG. 8) formed therein. The opening 52 overlaps an opening 23C (see FIG. 16) formed in the stage placing portion 22C of the image forming unit 21C and communicates with a toner storing portion 31C (see FIG. 1) of the image forming unit 21C. The opening 53 overlaps an opening 23M (see FIG. 16) formed in the stage placing portion 22M of the image forming unit 21M and communicates with a toner storing portion 31M (see FIG. 1) of the image forming unit 21M. The opening 54 overlaps an opening 23Y (see FIG. 16) formed in the stage placing portion 22Y of the image forming unit 21Y and communicates with the toner storing portion 31Y (see FIG. 1) of the image forming unit 21Y.

As illustrated in FIG. 3, the stage 3 includes a left side wall 55L and a right side wall 55R on both sides of the bottom portion 51. A left guide groove 56L is formed in an inside of the left side wall 55L to extend in the longitudinal direction. The left guide groove 56L receives and guides a left rear guide post 78L described later (see FIG. 5) of the toner cartridge 4. A right guide groove 56R is formed in an inside of the right side wall 55R to extend in the longitudinal direction. The right guide groove 56R receives and guides a right rear guide post 78R described later (see FIG. 4) of the toner cartridge 4. A left guide projection 60L is formed at an upper portion of a front end portion of the left side wall 55L. The left guide projection 60L supports and guides a left lower edge portion 90L described later (see FIG. 5) of the toner cartridge 4. A right guide projection 60R is formed at an upper portion of a front end portion of the right side wall 55R. The right guide projection 60R supports and guides right lower edge portions 90R described later (see FIG. 4) of the toner cartridge 4.

A holder holding portion 57 as a support is formed at a rear portion (or on a rear side) of the side walls 55L and 55R. The holder holding portion 57 is higher than front sides of the side walls 55L and 55R. In the holder holding portion 57, a left guide long hole 58L is formed in the left side wall 55L, and a right guide long hole 58R is formed in the right side wall 55R. The guide long holes 58L and 58R support a toner cartridge holder 65 (described later) slidably in the longitudinal direction. The holder holding portion 57 supports the toner cartridge holder 65 slidably within a slide region defined by the guide long holes 58L and 58R, in an attachment direction in which the toner cartridge 4 is attached to and removed from the stage 3.

As illustrated in FIGS. 4 to 7, the toner cartridge 4 has a substantially rectangular parallelepiped shape. The inside of the toner cartridge 4 is divided by partitions 72 and 73 (see FIG. 7) into three toner chambers as developer storing portions: a toner chamber 74Y that stores yellow (Y) toner, a toner chamber 74M that stores magenta (M) toner, and a toner chamber 74C that stores cyan (C) toner. When the toner chambers 74Y, 74M, and 74C need not be distinguished from each other, they will be referred to as the toner chambers 74.

A handle 70 is formed at a front end portion of the toner cartridge 4. The handle 70 is grasped mainly when the toner cartridge 4 is inserted into or removed from the stage 3 (see FIG. 3). The left rear guide post 78L, a left overhanging portion 76L, a left front guide post 79L, and a left engagement hole 75L are formed in a left side 71L of the toner cartridge 4. The left engagement hole 75L engages with a left hook 67L described later (see FIG. 10B) of the toner cartridge holder 65. The right rear guide post 78R, right overhanging portions 76R, a right front guide post 79R, and a right engagement hole 75R are formed in a right side 71R of the toner cartridge 4. The right engagement hole 75R engages with a right hook 67R described later (see FIG. 10B) of the toner cartridge holder 65.

Three openings 81Y, 81M, and 81C as developer supply ports are formed in a bottom portion 80 of the toner cartridge 4 (see FIG. 6). The openings 81Y, 81M, and 81C are respectively located at bottoms of the three toner chambers 74Y, 74M, and 74C. A sponge 84 is disposed at the edge of the opening 81Y. A sponge 83 is disposed at the edge of the opening 81M. A sponge 82 is disposed at the edge of the opening 81C. These sponges 82 to 84 are formed so that they slightly project downward from the openings and an opening/closing shutter 85 (described later) slides on them.

These openings 81Y, 81M, and 81C are configured so that they can be opened and closed by the opening/closing shutter 85 as a shutter, which is slidably held on the bottom portion 80. The opening/closing shutter 85 is a plate-like member having three openings 85*a*, 85*b*, and 85*c*, and extends in a longitudinal direction (or the direction in which the three toner chambers 74 are adjacent) of the toner cartridge 4. The opening/closing shutter 85 is held slidably in the longitudinal direction of the toner cartridge 4 by three holding plates 88 disposed at three positions in the longitudinal direction of the toner cartridge 4.

The opening/closing shutter 85 includes a spring receiver 85*d* (see FIG. 7) and is urged in the direction of arrow A in FIG. 7, which is an insertion direction of the toner cartridge 4, by a compression spring 86 as an urging member placed or suspended in a compressed state between the spring receiver 85*d* and a main body 89 of the toner cartridge 4. A leading end of the opening/closing shutter 85 is pressed against a movement limiter 77 (see FIG. 7) formed in the toner cartridge 4, thereby preventing the opening/closing shutter 85 from further moving in the insertion direction due to the urging of the compression spring 86.

At this time, the toner cartridge 4 is in a closed state where the openings 81C, 81M, and 81Y as the developer supply ports face a part of the opening/closing shutter 85 other than the openings 85*a*, 85*b*, and 85*c* and are closed (see FIG. 7). FIG. 6 illustrates an open state of the toner cartridge 4 where the openings 81C, 81M, and 81Y of the toner cartridge 4 respectively overlap the openings 85*a*, 85*b*, and 85*c* of the opening/closing shutter 85 and are opened.

As illustrated in FIG. 7, the toner cartridge 4 further includes an agitating shaft 87 rotatably supported and extending in the longitudinal direction of the toner cartridge 4 across the three toner chambers 74Y, 74M, and 74C. The agitating shaft 87 includes a passive gear 93 at its tip portion in the insertion direction (or the direction of arrow A). As described later, when the toner cartridge 4 is attached to the stage 3, the passive gear 93 meshes with a compound gear 101 (see FIG. 15) disposed on the stage 3 side and receives driving force from the compound gear 101 to rotate.

Figure 8:
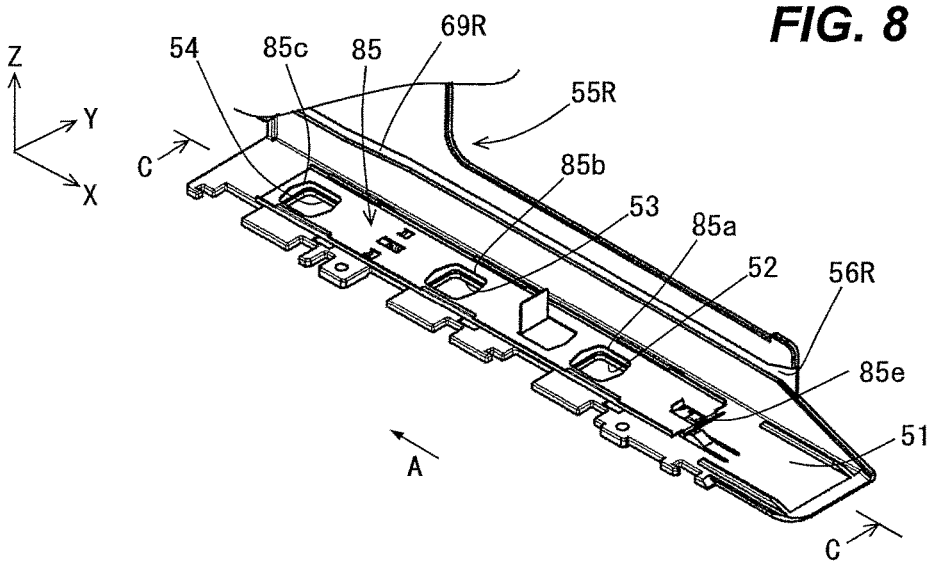
FIG. 8 is a configuration diagram for explaining the relationship between the stage and an opening/closing shutter.

The engagement or relationship between the opening/closing shutter 85 of the toner cartridge 4 and the stage 3 will be described. FIG. 8 is a configuration diagram for explaining the relationship between the stage 3 and the opening/closing shutter 85. To illustrate the internal configuration, FIG. 8 illustrates only the bottom portion 51 and a part of the right side wall 55R of the stage 3 and the opening/closing shutter 85 of the toner cartridge 4.

Figure 9A:
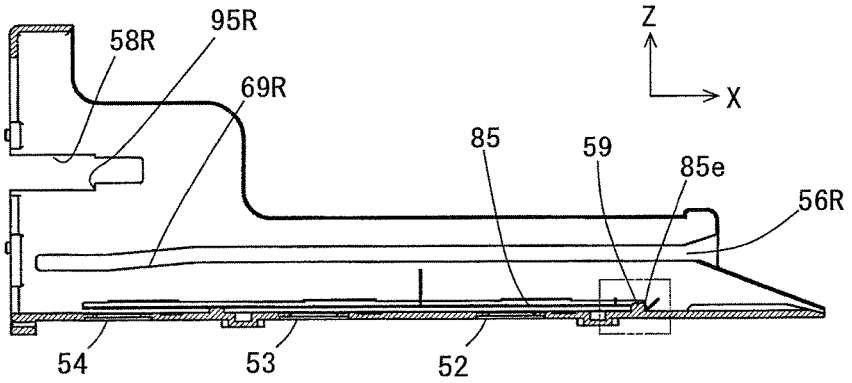
FIG. 9A is a sectional view taken along line C-C in FIG. 8.
Figure 9B:
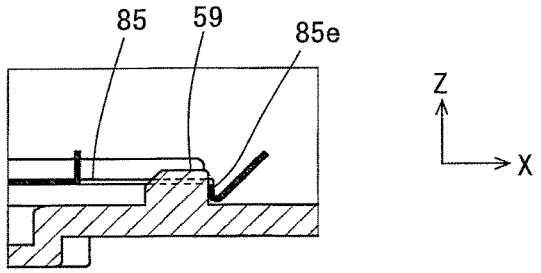
FIG. 9B is a partial enlarged view of a part enclosed by the chain double-dashed line in FIG. 9A.

FIG. 9A is a sectional view taken along line C-C in FIG. 8. FIG. 9B is a partial enlarged view of a part enclosed by the chain double-dashed line in FIG. 9A.

As illustrated in these drawings, the opening/closing shutter 85 includes, at its rear end portion in the insertion direction (or the direction of arrow A) of the toner cartridge 4, an engagement portion 85*e* extending (or bent) in a direction substantially perpendicular to a direction (or the longitudinal direction of the toner cartridge 4) in which the opening/closing shutter 85 extends. As described later, when the toner cartridge 4 is inserted in the stage 3 (see FIG. 3) in the direction of arrow A and moved on the bottom portion 51 (see FIG. 3) in the direction of arrow A, and the openings 85*a*, 85*b*, and 85*c* come into overlap with the openings 52, 53, and 54 of the stage 3 as illustrated in FIG. 8, the engagement portion 85*e* comes into engagement with an engagement projection 59 as a shutter movement limiter formed in the stage 3, as illustrated in FIG. 9B. At this time, the opening/closing shutter 85 is prevented from further moving in the direction of arrow A. Hereinafter, the position of the toner cartridge 4 on the stage 3 at this time may be referred to as the opening/closing position.

Figure 10A:
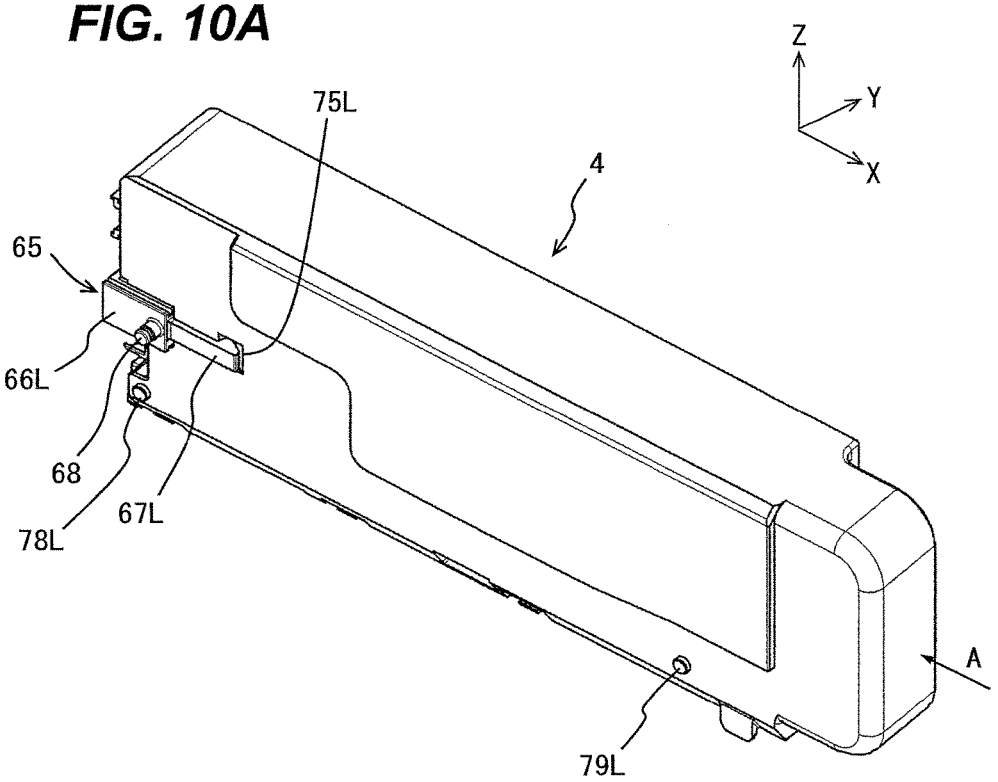
FIG. 10A illustrates a state where the toner cartridge is held by a toner cartridge holder.
Figure 10B:
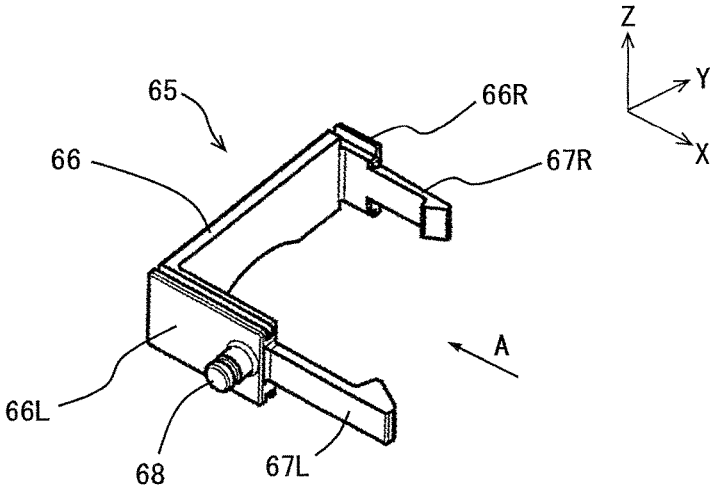
FIG. 10B is a perspective view of the toner cartridge holder.

The engagement or relationship between the toner cartridge 4 and the toner cartridge holder 65 as a holder of the stage 3 will be described. FIG. 10A illustrates a state where the toner cartridge 4 is held by the toner cartridge holder 65. FIG. 10B is a perspective view of the toner cartridge holder 65.

As illustrated in FIG. 10B, the toner cartridge holder 65 includes a substantially U-shaped base 66 with a left arm 66L and a right arm 66R, the left hook 67L extending from the left arm 66L in a direction opposite to the direction of arrow A, and the right hook 67R extending from the right arm 66R in a direction opposite to the direction of arrow A. An engagement pin 68 stands on the left arm 66L. The engagement pin 68 engages with and holds an end of a torsion spring 61 (described later). The left hook 67L and right hook 67R are flexible.

As illustrated in FIG. 3, the toner cartridge holder 65 is supported slidably in the longitudinal direction of the stage 3 with the left arm 66L and right arm 66R guided by the left guide long hole 58L and right guide long hole 58R formed in the stage 3. The toner cartridge holder 65 is urged in a predetermined direction by the torsion spring 61 as an elastic member placed or suspended on the left side of the stage 3 between the engagement pin 68 of the toner cartridge holder 65 and an engagement portion 63 (see FIGS. 11A to 11C) of a main body 50 of the stage 3, as described later.

FIG. 3 illustrates a state where the toner cartridge holder 65 is urged by the torsion spring 61 against the main body 50 of the stage 3 in a direction opposite to the direction of arrow A, and the left arm 66L and right arm 66R abut respective limiting portions (or stepped portions) 95L (see FIG. 11C) and 95R (see FIG. 9A) of the left guide long hole 58L and right guide long hole 58R, so that the toner cartridge holder 65 is prevented from further moving in the direction opposite to the direction of arrow A. Hereinafter, the position of the toner cartridge holder 65 at this time may be referred to as the initial position.

FIG. 10A illustrates the positional relationship in a state where the toner cartridge 4 has been inserted up to the opening/closing position and caught or held by the toner cartridge holder 65 located at the initial position on the stage 3. In this state, a rear (or back) end portion of the toner cartridge 4 abuts the substantially U-shaped base 66 of the toner cartridge holder 65, the flexible left hook 67L of the toner cartridge holder 65 is fitted in the left engagement hole 75L, and the flexible right hook 67R of the toner cartridge holder 65 is fitted in the right engagement hole 75R (see FIG. 4), thereby preventing the toner cartridge 4 from naturally coming off the toner cartridge holder 65.

Figure 11A:
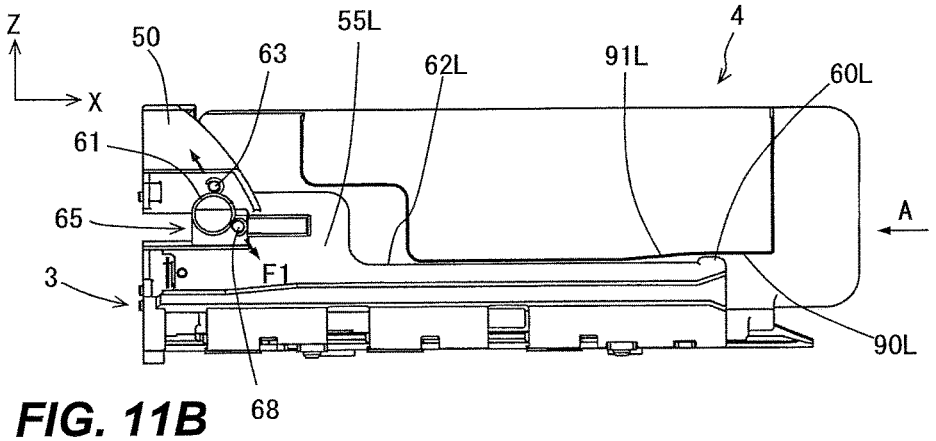
FIGS. 11A to 11C are diagrams for explaining the attachment of the toner cartridge 4, FIG. 11A illustrating a state where the toner cartridge has been inserted up to an opening/closing position and held by the toner cartridge holder at an initial position, FIG. 11B illustrating a state where the toner cartridge has been further moved in the direction of arrow A against urging of a torsion spring, FIG. 11C illustrating a state where the toner cartridge has reached an attachment position.
Figure 11B:
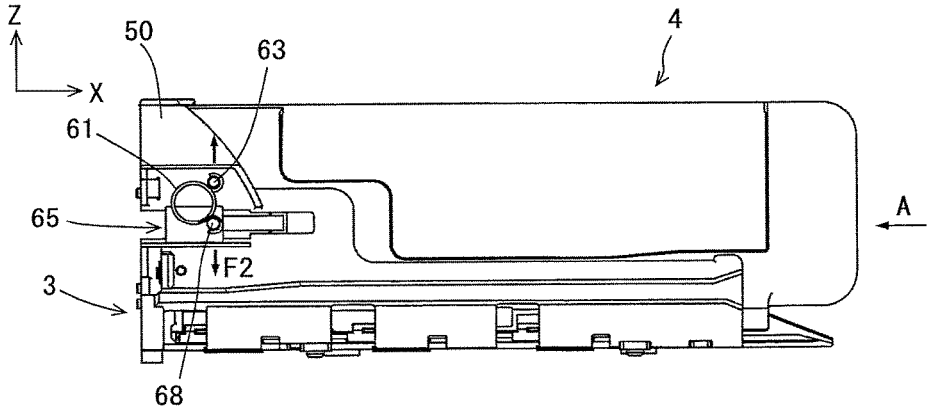
Figure 11C:
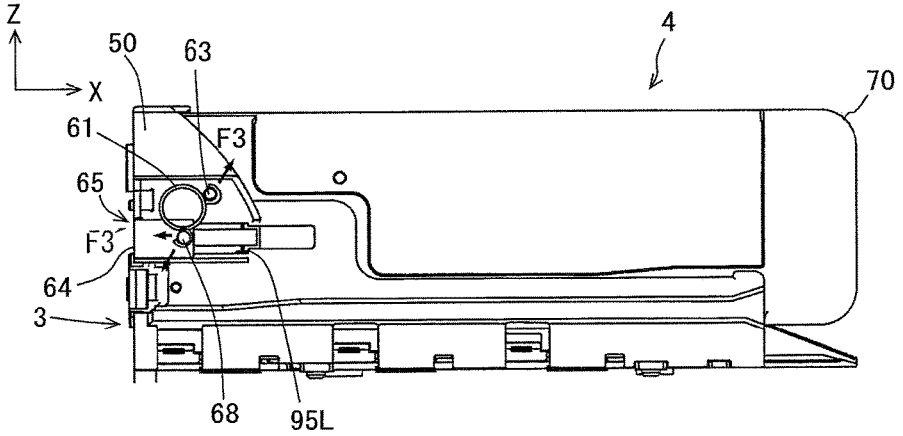

The attachment operation of the toner cartridge 4 will now be described. FIGS. 11A to 11C are diagrams for explaining the attachment of the toner cartridge 4. FIG. 11A illustrates a state where the toner cartridge 4 has been inserted up to the opening/closing position and held by the toner cartridge holder 65 located at the initial position, as described with reference to FIG. 10A. FIG. 11B illustrates a state where the toner cartridge 4 has been further moved in the direction of arrow A against the urging of the torsion spring 61. FIG. 11C illustrates a state where the toner cartridge 4 has reached an attachment position.

When the toner cartridge 4 is moved in the direction of arrow A to be attached to the stage 3, it is guided by the stage 3. Specifically, on the leading end side (or back side), the left rear guide post 78L is guided by the left guide groove 56L of the stage 3, and the right rear guide post 78R is guided by the right guide groove 56R of the stage 3. On the rear end side (or front side), the lower edge portion 90L of the left overhanging portion 76L is guided by the left guide projection 60L of the left side wall 55L of the stage 3, and the lower edge portions 90R of the right overhanging portions 76R are guided by the right guide projection 60R of the right side wall 55R of the stage 3.

Before the right rear guide post 78R of the toner cartridge 4 and a slope section 91L of the lower edge portion 90L of the toner cartridge 4 simultaneously and respectively pass through a slope section 69R of the right guide groove 56R of the stage 3 and the left guide projection 60L of the stage 3, the toner cartridge 4 smoothly moves in the direction of arrow A while it is slightly separated from the bottom portion 51 of the stage 3. After the right rear guide post 78R and slope section 91L pass through the slope section 69R and left guide projection 60L, the toner cartridge 4 translates (or moves parallel to the bottom portion 51) to the opening/closing position (illustrated in FIG. 11A), at which the openings 85*a*, 85*b*, and 85*c* of the opening/closing shutter 85 are close to and overlap the openings 52, 53, and 54 of the stage 3, respectively. The openings 52, 53, and 54 of the stage 3 serve as developer receiving openings.

FIG. 11A illustrates a state where the toner cartridge 4 has been inserted up to the opening/closing position and held by the toner cartridge holder 65 located at the initial position, as described with reference to FIG. 10A. At this time, the engagement portion 85*e* of the opening/closing shutter 85 of the toner cartridge 4 abuts the engagement projection 59 of the stage 3 as illustrated in FIG. 9B, and the toner cartridge holder 65 is urged by the torsion spring 61 at the initial position in the direction opposite to arrow A.

The torsion spring 61 is placed or suspended in a compressed state between the engagement pin 68 of the toner cartridge holder 65 and the engagement portion 63 of the main body 50 of the stage 3, with one end engaged with the engagement pin 68 and the other end engaged with the engagement portion 63. When the toner cartridge holder 65 is located at the initial position, the engagement pin 68 of the toner cartridge holder 65 is located in the positive X direction (or the direction opposite to arrow A) from the engagement portion 63 of the main body 50 of the stage 3, as illustrated in FIG. 11A. Thus, the toner cartridge holder 65 is urged in the positive X direction (or the direction opposite to arrow A) by a component in the positive X direction of a force F1 occurring between the ends of the torsion spring 61 (or exerted on the engagement pin 68 by the torsion spring 61) at this time.

From this state, when the toner cartridge 4 is pushed in the direction of arrow A (or the negative X direction) against the urging force, the toner cartridge holder 65 moves in the negative X direction (or the direction of arrow A) along the left and right guide long holes 58L and 58R (see FIG. 3) while holding the toner cartridge 4 as illustrated in FIG. 10, and the engagement pin 68 moves to a position just beneath the engagement portion 63 of the main body 50 of the stage 3 as illustrated in FIG. 11B. At this time, since the opening/closing shutter 85 of the toner cartridge 4 is prevented from moving in the direction of arrow A, the opening/closing shutter 85 moves toward its open position relative to the main body 89 of the toner cartridge 4.

At this time, the engagement pin 68 is at its closest position to the engagement portion 63, and thus the force F2 occurring between the ends of the torsion spring 61 (or exerted on the engagement pin 68 by the torsion spring 61) is maximum. However, the direction of the force F2 is vertical, and thus the component of the force F2 in the direction of the X axis is zero. Thus, the force F2 does not affect movement of the toner cartridge 4.

When the toner cartridge 4 is further pushed by an operator in the direction or arrow A (or the negative X direction) against the urging force of the compression spring 86 occurring with the movement of the opening/closing shutter 85, the toner cartridge holder 65 moves in the direction of arrow A while holding the toner cartridge 4 as illustrated in FIG. 10, and comes into contact with a rear wall 64 (see FIG. 3) of the stage 3 as illustrated in FIG. 11C, so that the toner cartridge 4 is installed at a predetermined attachment position.

At this time, when the toner cartridge 4 further moves in the direction of arrow A after passing through the position of FIG. 11B where the engagement pin 68 of the toner cartridge holder 65 is just beneath the engagement portion 63 of the main body 50 of the stage 3, the torsion spring 61 produces a force component in the negative X direction. This force component assists the operator to move the toner cartridge 4 in the direction of arrow A, and allows the operator to install the toner cartridge 4 at the attachment position with a small pushing force or without exerting a pushing force on the toner cartridge 4.

Figure 12A:
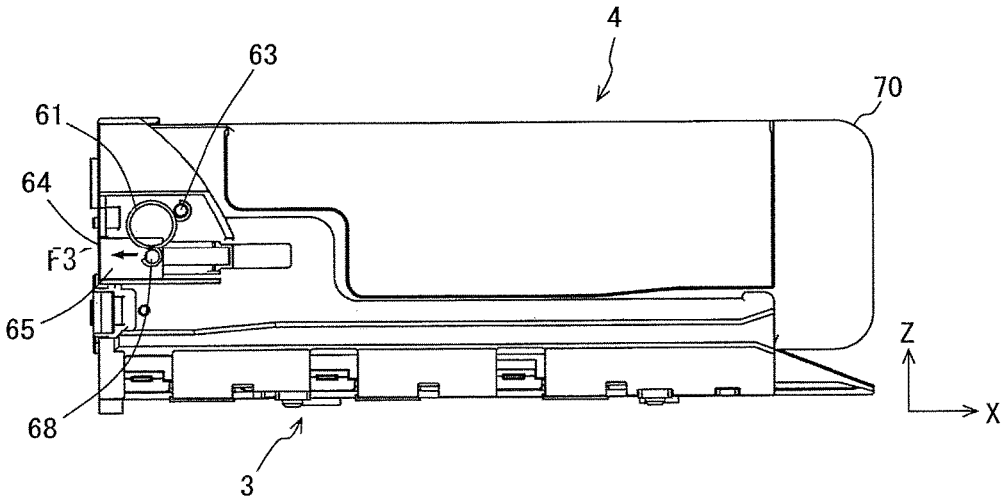
FIGS. 12A to 12C are diagrams for explaining the positional relationship between parts of the toner cartridge and stage, and forces exerted on parts of the toner cartridge and stage when the toner cartridge is located at the attachment position, FIG. 12A being an external view, FIG. 12B being an internal configuration diagram, FIG. 12C being a partial enlarged view of a part enclosed by the dashed line in FIG. 12B.
Figure 12B:
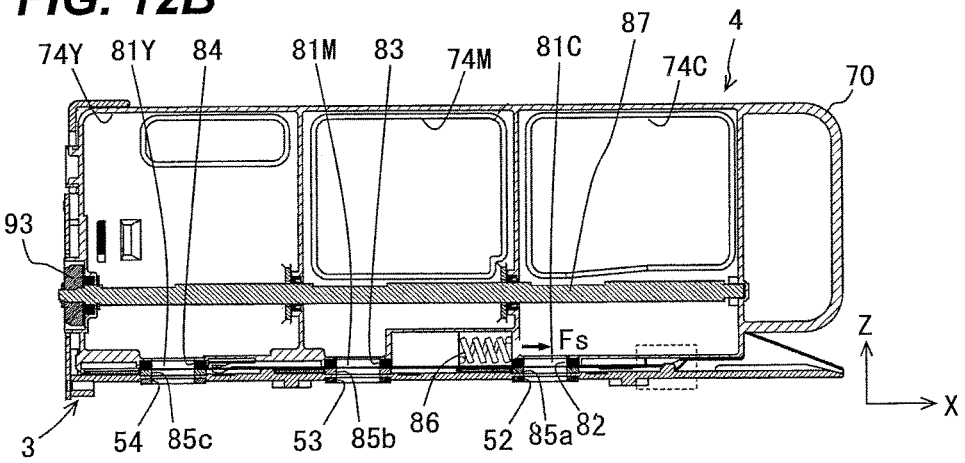
Figure 12C:
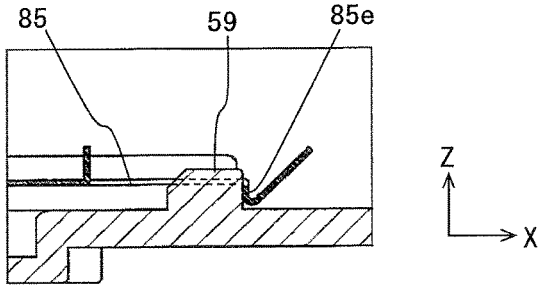

FIGS. 12A to 12C are diagrams for explaining the positional relationship between parts of the toner cartridge 4 and stage 3, and forces exerted on parts of the toner cartridge 4 and stage 3 when the toner cartridge 4 is located at the attachment position. FIG. 12A is an external view. FIG. 12B is an internal configuration diagram. FIG. 12C is a partial enlarged view of a part enclosed by the dashed line in FIG. 12B.

As illustrated in FIG. 12A, when the toner cartridge 4 is located at the attachment position, the engagement pin 68 of the toner cartridge holder 65 is located in the negative X direction (or the direction of arrow A) from the engagement portion 63 of the main body 50 of the stage 3. Thus, the toner cartridge holder 65 is urged toward the rear wall 64 (see FIG. 3) of the stage 3 by the component F3' in the negative X direction of the force F3 (see FIG. 11C) occurring between the ends of the torsion spring 61 (or exerted on the engagement pin 68 by the torsion spring 61) at this time.

Meanwhile, as illustrated in FIG. 12B, when the toner cartridge 4 reaches the attachment position, the opening/closing shutter 85, which is prevented from moving in the insertion direction, relatively moves to its open position, and simultaneously the openings 81Y, 81M, and 81C of the toner cartridge 4 respectively come into overlap with the openings 54, 53, and 52 of the stage 3, so that the three toner chambers 74Y, 74M, and 74C of the toner cartridge 4 come into communication with the corresponding toner storing portions 31Y, 31M, and 31C (see FIG. 1) of the respective image forming units 21 (see FIG. 1).

At this time, the engagement portion 85*e* is engaged with the engagement projection 59 of the stage 3 as illustrated in FIG. 12C, and movement of the opening/closing shutter 85 is restricted. The compression spring 86 is compressed more than when the opening/closing shutter 85 is at its closed position as illustrated in FIG. 7, and urges the main body 89 of the toner cartridge 4 in the positive X direction with an urging force Fs.

Thus, to stably hold the toner cartridge 4 at the attachment position, it is necessary to urge the toner cartridge 4 against the rear wall 64 (see FIG. 3) of the stage 3 with the force component F3' produced by the torsion spring 61. For this purpose, it is necessary to satisfy at least the following relationship:

$$F3'>Fs.$$

When the attached toner cartridge 4 is drawn, an operator pulls the toner cartridge 4 in the positive X direction (or the direction opposite to arrow A) using the handle 70. At this time, the toner cartridge 4 moves together with the toner cartridge holder 65 holding the toner cartridge 4, from the attachment position illustrated in FIG. 11C through the position of FIG. 11B to the opening/closing position illustrated in FIG. 11A. Meanwhile, the urging force of the compression spring 86 moves the opening/closing shutter 85 from its open position to its closed position, and keeps the opening/closing shutter 85 at its closed position.

Further, in addition to the urging force of the compression spring 86, after the toner cartridge 4 passes through the position of FIG. 11B, the torsion spring 61 produces a force component in the positive X direction. These forces assists the operator to move the toner cartridge 4 from the attachment position illustrated in FIG. 11C to the opening/closing position illustrated in FIG. 11A.

The holding force of the toner cartridge holder 65 needs to be set so that the toner cartridge holder 65 keeps holding (or does not release) the toner cartridge 4 while the toner cartridge 4 is drawn from the attachment position illustrated in FIG. 11C to the opening/closing position illustrated in FIG. 11A.

When the toner cartridge 4 reaches the opening/closing position, the toner cartridge holder 65 reaches the initial position and thus is prevented from further moving in the positive X direction. Thus, the operator exerts, on the toner cartridge 4 held by the toner cartridge holder 65 as illustrated in FIG. 10A, a force required to bend the hooks 67L and 67R to disengage them from the engagement holes 75L and 75R, and draws and moves the toner cartridge 4 from the opening/closing position in the positive X direction.

At this time, when the right rear guide post 78R of the toner cartridge 4 and the slope section 91L of the lower edge portion 90L of the toner cartridge 4 simultaneously and respectively pass through the slope section 69R of the right guide groove 56R of the stage 3 and the left guide projection 60L of the stage 3, the toner cartridge 4 is slightly separated from the bottom portion 51 of the stage 3. Thus, the toner cartridge 4 smoothly moves in the positive X direction. This allows the operator to smoothly draw the toner cartridge 4 with the opening/closing shutter 85 closed, from the opening/closing position.

In the above example, the toner cartridge holder 65 located at the initial position catches or holds the toner cartridge 4 simultaneously with the arrival of the toner cartridge 4 at the opening/closing position. However, this is not mandatory. For example, the stage 3 and toner cartridge 4 may be configured so that, when the toner cartridge 4 is inserted into the stage 3, before the toner cartridge 4 arrives at the opening/closing position, the toner cartridge holder 65 located at the initial position catches or holds the toner cartridge 4. In this configuration, when the toner cartridge 4 is drawn, before the toner cartridge holder 65 returns to the initial position, the opening/closing shutter 85 of the toner cartridge 4 is closed. This can prevent toner leakage when the toner cartridge 4 is installed or removed.

As described above, the torsion spring 61 urges the toner cartridge holder 65 in the negative X direction when the toner cartridge holder 65 is located on the negative X side of the position of FIG. 11B in the slide region and in the positive X direction when the toner cartridge holder 65 is located on the positive X side of the position of FIG. 11B in the slide region.

Next, connection of a rotation transmitting system for driving and rotating the agitating shaft 87 disposed in the toner cartridge 4 when the toner cartridge 4 is attached will be described.

Figure 13A:
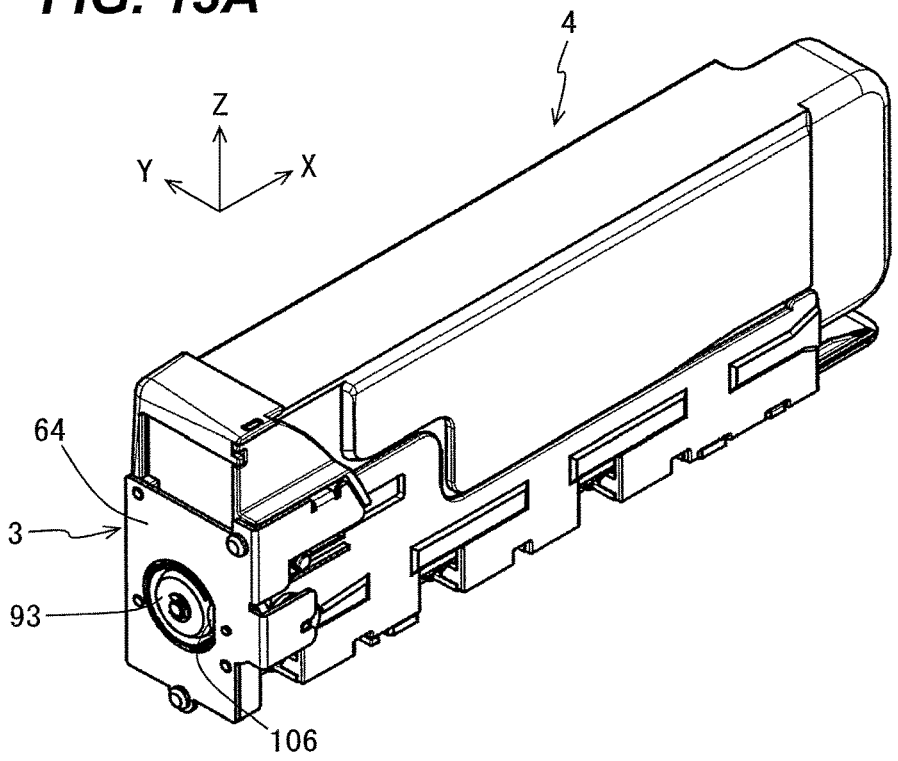
FIG. 13A is an external perspective view of the stage and the toner cartridge attached to the stage as viewed obliquely from above.
Figure 13B:
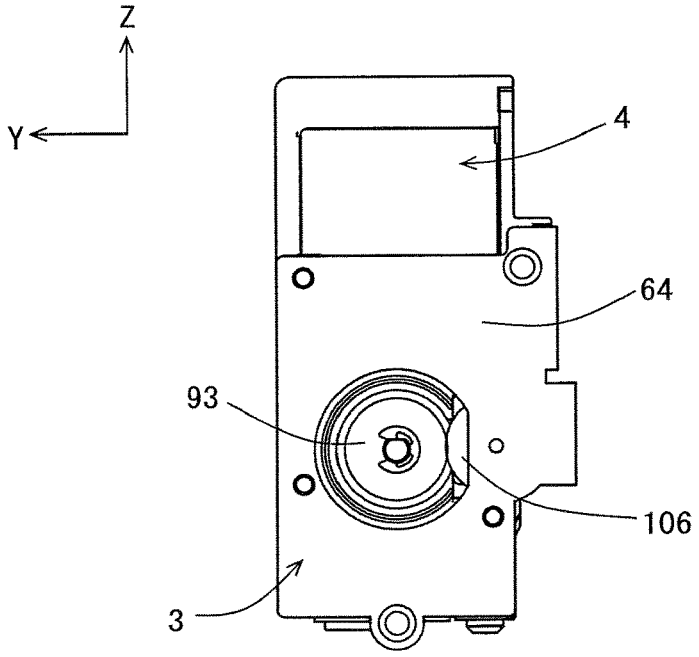
FIG. 13B is a rear view of the stage and toner cartridge as viewed from the rear.
Figure 14A:
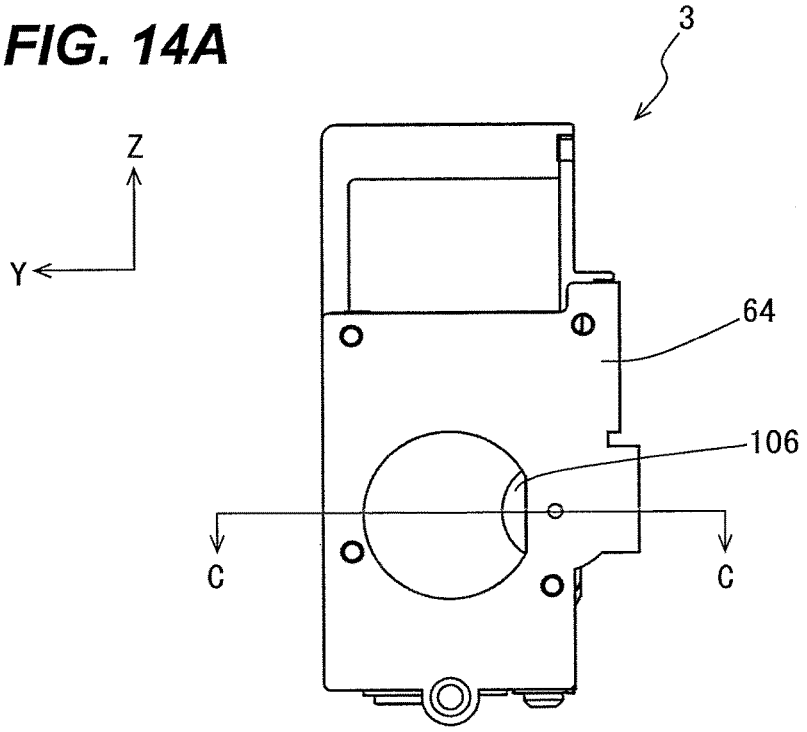
FIG. 14A is a rear view of the stage as viewed from the rear.
Figure 14B:
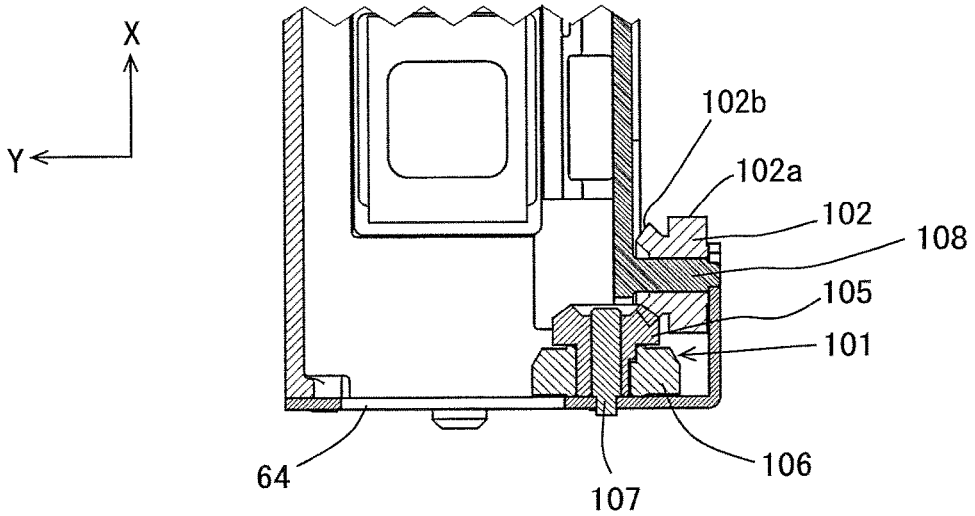
FIG. 14B is a sectional view taken along line C-C in FIG. 14A.
Figure 15A:
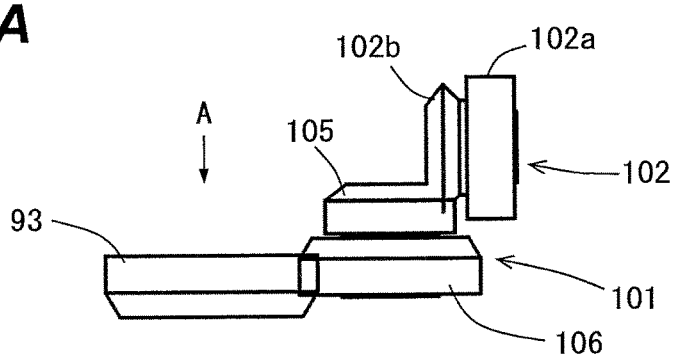
FIGS. 15A to 15D are diagrams illustrating the connection relationship between gears, FIG. 15A being a plan view of the gears meshing with each other, FIG. 15B being an external perspective view of the gears meshing with each other, FIG. 15C being an external perspective view of a compound gear, FIG. 15D being an exploded perspective view of the compound gear.
Figure 15B:
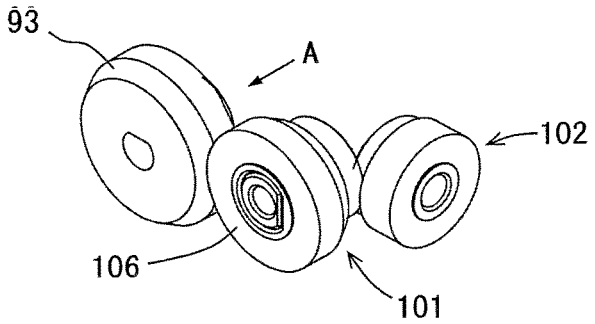
Figure 15C:
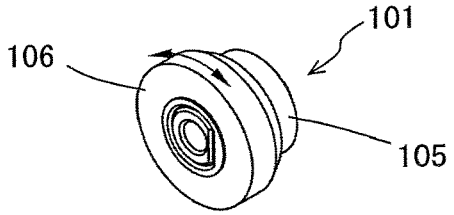
Figure 15D:
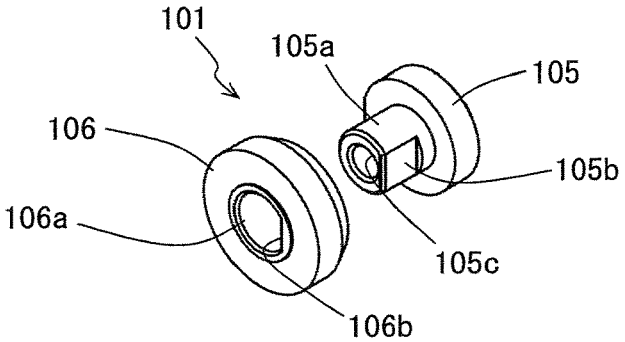

FIG. 13A is an external perspective view of the stage 3 and the toner cartridge 4 attached to the stage 3 as viewed obliquely from above, and FIG. 13B is a rear view of them as viewed from the rear (or in the positive X direction). FIG. 14A is a rear view of the stage 3 as viewed from the rear (or in the positive X direction), and FIG. 14B is a sectional view taken along line C-C in FIG. 14A. FIGS. 15A to 15D are diagrams illustrating the connection relationship between gears. FIG. 15A is a plan view of the gears meshing with each other. FIG. 15B is an external perspective view of the gears meshing with each other. FIG. 15C is an external perspective view of the compound gear 101. FIG. 15D is an exploded perspective view of the compound gear 101.

As illustrated in FIGS. 13A and 13B, the passive gear 93, which is fixed to the rear end portion of the agitating shaft 87 of the toner cartridge 4, is meshed with a second gear 106 of the compound gear 101 disposed in the stage 3 when the toner cartridge 4 is attached to the stage 3.

As illustrated in FIG. 14B, the compound gear 101 includes a first gear 105 with a bevel gear and the second gear 106. The compound gear 101 is rotatably supported by a rotating shaft 107 extending from the rear wall 64 of the stage 3 in the positive X direction so that the first gear 105 and second gear 106 can rotate integrally with each other.

A drive gear 102 is rotatably supported by a rotating shaft 108 disposed on the stage 3 to extend in the direction of the Y axis. The drive gear 102 includes a first gear 102*a* and a second gear 102*b* with a bevel gear. The bevel gear of the second gear 102*b* of the drive gear 102 meshes with the bevel gear of the first gear 105 of the compound gear 101, and rotation transmitted from a drive source to the first gear 102*a* of the drive gear 102 is transmitted to the compound gear 101. The compound gear 101 and drive gear 102 constitute a gear train.

As illustrated in FIG. 15D, the first gear 105 of the compound gear 101 includes a cylindrical shaft portion 105*a* formed integrally with the bevel gear. A cutout plane 105*b* is formed in a peripheral surface of the shaft portion 105*a*. A shaft hole 105*c* in which the rotating shaft 107 is fitted is formed in the shaft portion 105*a*. The second gear 106 of the compound gear 101 is a spur gear with teeth formed on its outer periphery and with an engagement hole 106*a* for receiving the shaft portion 105*a* of the first gear 105 formed in its central portion. An engagement plane 106*b* for engaging with the cutout plane 105*b* of the shaft portion 105*a* is formed in the engagement hole 106*a*.

The first gear 105 and second gear 106 are configured as follows. The shaft portion 105*a* of the first gear 105 is fitted in the engagement hole 106*a* of the second gear 106, so that the first gear 105 and second gear 106 are integrated as illustrated in FIG. 15C. In this state, a slight gap is formed between the cutout plane 105*b* and the engagement plane 106*b*, thereby providing a slight play between the first gear 105 and the second gear 106 in their rotational direction (or the direction of the arrow in FIG. 15C).

When the toner cartridge 4 is attached to the stage 3, the passive gear 93 fixed to the agitating shaft 87 moves in the direction of arrow A in FIGS. 15A and 15B, and finally meshes with the spur gear teeth formed on the outer periphery of the second gear 106 of the compound gear 101, as illustrated in FIGS. 15A and 15B. At this time, if the gear teeth of the passive gear 93 and the gear teeth of the second gear 106 abut each other and neither of them can escape from the other, it is difficult to mesh the passive gear 93 with the second gear 106. However, in this embodiment, the play between the first gear 105 and second gear 106 of the compound gear 101 allows the second gear 106 to slightly rotate, thereby facilitating meshing of the passive gear 93 with the second gear 106.

With this embodiment, the urging force of the torsion spring (or elastic member) 61 facilitates the attachment of the toner cartridge (or developer container) 4 to the stage (or developer container holder) 3, and eliminates the need for a locking mechanism for locking the toner cartridge 4 at the attachment position.

In the above description of the embodiment, the terms, such as "above", "below", "left", "right", "front", and "rear", for indicating positional relationships have been used. However, this is for convenience, and the terms are not intended to absolutely limit the positional relationships in a state where the stage 3 and toner cartridge 4 are arranged.

The present invention is not limited to the embodiment described above; it can be practiced in various other aspects without departing from the invention scope.

The above embodiment has described an example in which the present invention is applied to an image forming apparatus as a color printer. However, this is not mandatory, and the present invention is also applicable to image processing apparatuses, such as copiers, facsimile machines, or multi-function peripherals (MFPs). The present invention is applicable to not only to color printers but also to monochrome printers.

What is claimed is:

1. A developer container holder for removably holding a developer container including a developer supply port and a shutter for opening and closing the developer supply port, the developer container holder guiding the developer container in a first direction when the developer container is attached to the developer container holder and in a second direction when the developer container is removed from the developer container holder, the developer container holder comprising:

a holder that holds the developer container;

a support that supports the holder slidably within a predetermined slide region in an attachment direction in which the developer container is attached to and removed from the developer container holder; and an elastic member placed between the holder and the support, the elastic member urging the holder in the first direction when the holder is located on a first side of a predetermined position in the slide region and in the second direction when the holder is located on a second side of the predetermined position in the slide region.

2. The developer container holder of claim 1, wherein when the holder is located at an end of the slide region in the first direction while holding the developer container, the developer container is positioned at a predetermined attachment position.

3. The developer container holder of claim 2, further comprising a developer receiving opening that faces the developer supply port when the developer container is located at the attachment position.

4. The developer container holder of claim 1, further comprising a shutter movement limiter that, when the developer container is attached to the developer container holder, prevents the shutter from moving in the first direction after the developer container has moved by a predetermined amount in the first direction.

5. The developer container holder of claim 4, wherein the holder located at an end of the slide region in the second direction holds the developer container before the developer container has moved by the predetermined amount in the first direction.

6. The developer container configured to be removably held by the developer container holder of claim 4, the developer container comprising:

a main body including a developer storing portion that stores developer;

the developer supply port, which discharges the developer stored in the developer storing portion;

the shutter for opening and closing the developer supply port, the shutter being slidably held by the main body;

an urging member that urges the shutter in the first direction to close the shutter; and an engagement portion formed on the shutter, the engagement portion engaging with the shutter movement limiter of the developer container holder to prevent movement of the shutter in the first direction, wherein when the developer container is positioned at a predetermined attachment position, the shutter is opened against urging force of the urging member.

7. The developer container of claim 6, further comprising a handle for removing the developer container from the developer container holder.

8. The developer container of claim 6, wherein when the developer container is positioned at the predetermined attachment position, the developer supply port overlaps a developer receiving opening formed in the developer container holder in the attachment direction.

9. An image forming apparatus comprising the developer container holder of claim 4, wherein the developer container includes:

a main body including a developer storing portion that stores developer;

the developer supply port, which discharges the developer stored in the developer storing portion;

the shutter for opening and closing the developer supply port, the shutter being slidably held by the main body;

an urging member that urges the shutter in the first direction to close the shutter; and an engagement portion formed on the shutter, the engagement portion engaging with the shutter movement limiter of the developer container holder to prevent movement of the shutter in the first direction, wherein when the developer container is positioned at a predetermined attachment position, the shutter is opened against urging force of the urging member.

10. The image forming apparatus of claim 9, wherein:

the developer container includes an agitating shaft that agitates the developer and a passive gear fixed to an end portion of the agitating shaft;

the developer container holder includes a gear that meshes with the passive gear when the developer container is positioned at the predetermined attachment position, the gear rotating in a rotational direction to transmit drive to the passive gear; and the gear has a predetermined play in the rotational direction.

11. The image forming apparatus of claim 9, wherein F3' is greater than Fs, where Fs is the urging force of the urging member when the developer container is positioned at the predetermined attachment position, and F3' is a component in the first direction of force of the elastic member when the holder is located at an end of the slide region in the first direction while holding the developer container.

12. The image forming apparatus of claim 9, wherein:

the developer container holder includes an opposing surface that faces the shutter; and when the developer container is attached to the developer container holder, before the engagement portion comes into engagement with the shutter movement limiter, the developer container translates from a position where the shutter is slightly separated from the opposing surface to a position where the shutter is in contact with the opposing surface.

13. The developer container holder of claim 1, wherein the elastic member is a torsion spring.

14. The developer container holder of claim 1, wherein when the holder is located at an end of the slide region in the second direction while holding the developer container, the holder releases the developer container upon receiving a force exceeding a predetermined threshold in the second direction.

15. The developer container holder of claim 1, wherein when the developer container is attached to the developer container holder, the developer container moves from the second side to the first side.

* * * * *